United States Patent [19]

Drewett

[11] 4,270,128

[45] May 26, 1981

[54] RADIO ANTENNAE

[75] Inventor: Robert J. Drewett, Swindon, England

[73] Assignee: National Research Development Corporation, London, England

[21] Appl. No.: 27,284

[22] Filed: Apr. 4, 1979

Related U.S. Application Data

[63] Continuation-in-part of Ser. No. 808,384, Jun. 20, 1977, Pat. No. 4,160,979.

[30] Foreign Application Priority Data

Jun. 21, 1976 [GB] United Kingdom ..... 25727/76
Apr. 1, 1977 [GB] United Kingdom ..... 13928/77

[51] Int. Cl.[3] ..... H01Q 1/36

[52] U.S. Cl. ..... 343/702; 343/788; 343/895

[58] Field of Search ..... 343/749, 895, 702, 787, 343/788

[56] References Cited

U.S. PATENT DOCUMENTS

| | | | |
|---|---|---|---|
| 2,153,975 | 4/1939 | Smith et al. | 343/749 |
| 2,511,611 | 6/1950 | Wheeler | 343/895 |
| 3,774,221 | 11/1973 | Francis | 343/787 |
| 4,136,344 | 1/1979 | Nakao et al. | 343/702 |

FOREIGN PATENT DOCUMENTS

| | | | |
|---|---|---|---|
| 221590 | 6/1962 | Austria | 343/702 |
| 1260103 | 3/1961 | France | 343/895 |
| 840850 | 7/1960 | United Kingdom | 343/895 |

*Primary Examiner*—Eli Lieberman
*Attorney, Agent, or Firm*—Cushman, Darby & Cushman

[57] ABSTRACT

Compact radio antennae are disclosed which comprise an extended conductor, such as a wire, arranged to form an elongated structure. The conductor is arranged in a plurality of windings comprising windings of opposite senses positioned coaxially in proximate relation. In one form the conductor is arranged in a series of helical windings all coaxial, to form a cylindrical structure, and successive windings in the series are alternately left-handed and right-handed. In another form the conductor is arranged in a first helical winding forming a cylindrical structure and a second helical winding of opposite chirality to the first, but with the same number of turns and longitudinal extent and coaxial with it. A flux-concentrating core may be longitudinally disposed within the cylindrical structure. Antennae are particularly described for the HF, VHF and UHF bands.

9 Claims, 28 Drawing Figures

A — $\frac{\lambda}{4}$ MONOPOLE M1

B — DOUBLEWOUND ANTENNA C1

C — ANTENNA C1 WITH 'WHEELER CAN' MEASUREMENT

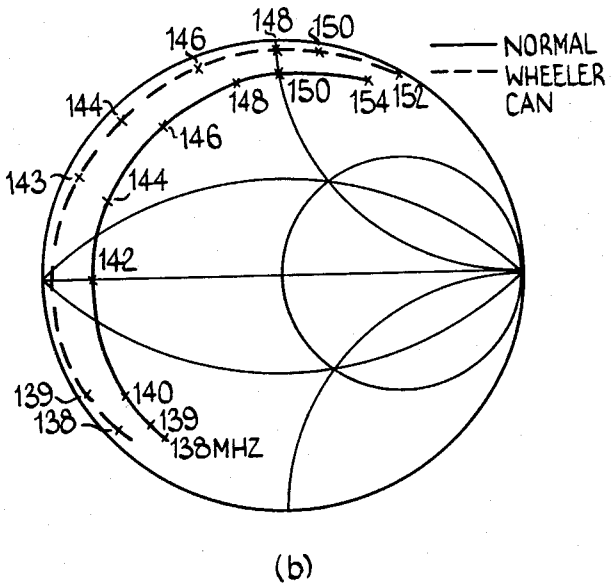
Fig. 19
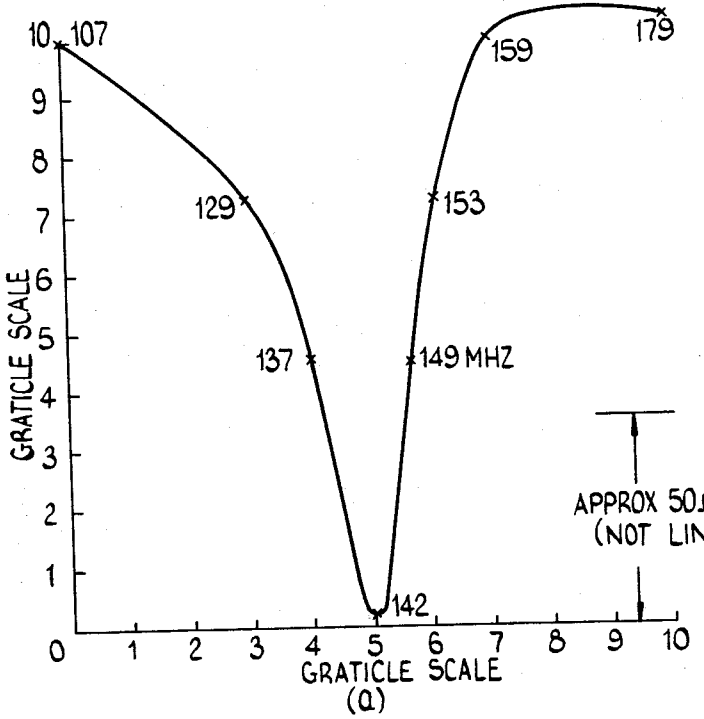

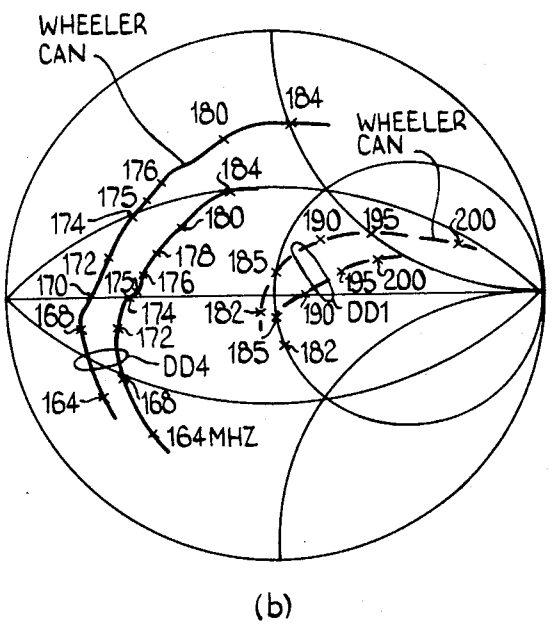
Fig 20
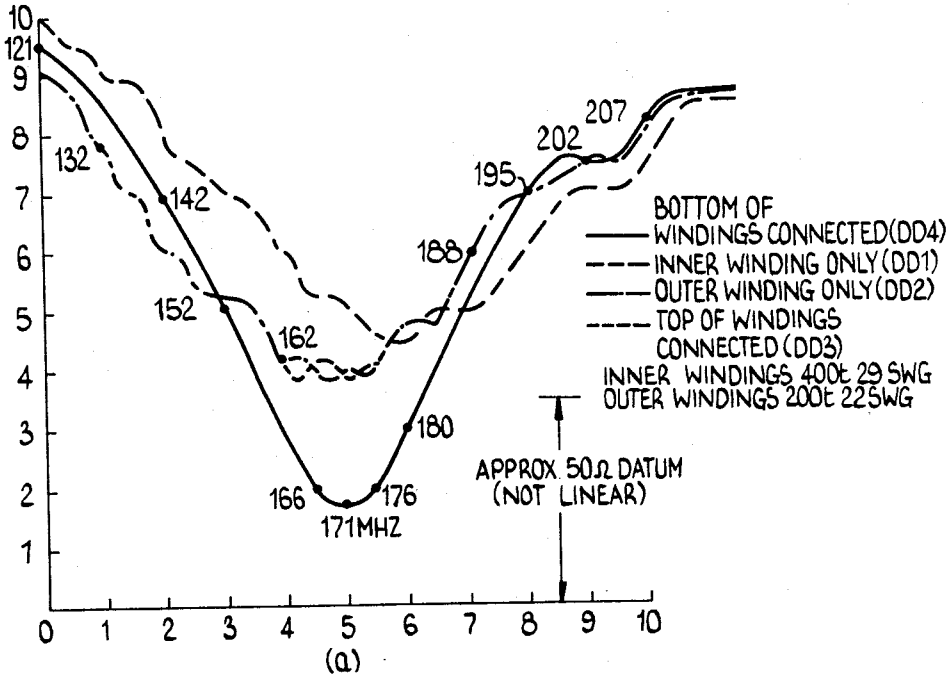

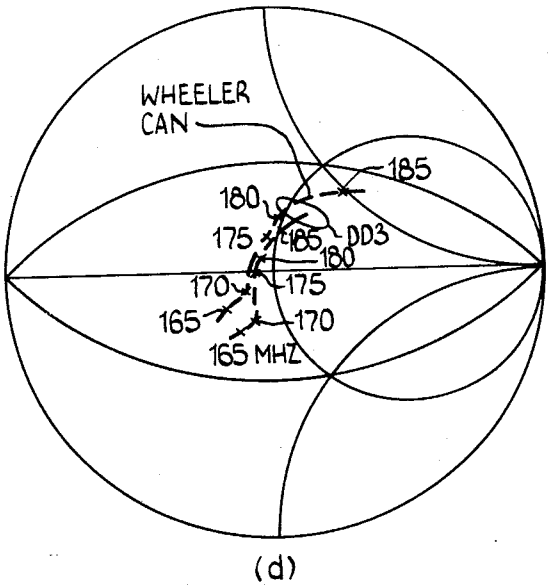
Fig. 21
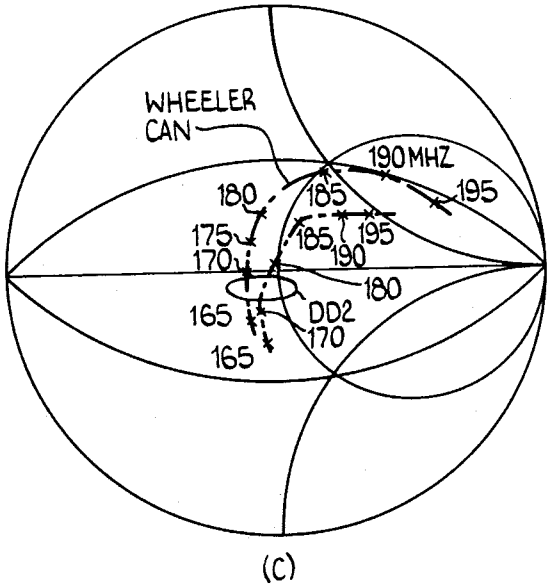

RADIO ANTENNAE

This application is a continuation-in-part of our copending parent application Ser. No. 808,384 filed June 20, 1977, now U.S. Pat. No. 4,160,979, in the name of R. J. Drewett and entitled 'Radio Antenna.'

This invention relates to radio antennae.

Portable radio sets operating in the VHF frequency band, such as walkie-talkie transceivers and domestic VHF receivers, generally use a whip type of aerial as antenna. While a VHF whip aerial is electrically satisfactory it is physically inconvenient because of its length and vulnerability to damage when extended. Since many VHF transmissions, particularly those intended for domestic reception, are horizontally polarised, whip aerials have to be extended almost horizontally to receive these transmissions, and this further aggravates the inconvenience already inherent in the length of the aerial. The awkward length and vulnerability of VHF whip aerials is particularly inconvenient for members of fire-fighting, police and other security services who may need to keep their radio equipment operating while moving quickly within buildings or in other congested situations.

The UHF frequency band is commonly used for public television transmissions, and while, because of the shorter wavelength, conventional UHF dipole or monopole antennae are reasonably compact, the recent development of small portable television receivers makes it desirable to have a more compact UHF antenna.

Whip aerials for use in the HF band are known and are generally even larger and more unwieldy than VHF whip aerials. Helical HF whip aerials are more compact, but they suffer from low band width and strong multiple resonances up to a high order.

A Japanese patent specification, publication No. 44-18967, in the name of Matsushita, discloses a helical antenna having an electrical length of about 1.6 wavelengths for radiating linearly polarised waves. The antenna comprises two helical antenna elements which are coiled in opposite directions and are combined superposedly around the same axis and which require balanced feed inputs. A phase delaying element is included in the inputs to obtain linearly polarised waves.

We have discovered that quarter wavelength antennae of particular counterwound and double-wound configurations have good characteristics over a wide band of operation and do not require complex phase delay feed arrangements for efficient operation.

According to the present invention there is provided a radio antenna comprising an extended conductor having an electrical length of one quarter of the design wavelength, said conductor being disposed in a plurality of insulated windings of opposite senses (i.e., opposite "chirality") and of substantially equal numbers of turns arranged coaxially in proximate relation.

The windings may be spiral and arranged in coaxial pairs, with the windings of one pair not necessarily coaxial with the windings of another pair. Preferably, however, the windings are all arranged coaxially to form a cylindrical structure and preferably the windings are helical.

In one form of the invention the windings form a series extending along the length of the structure, successive windings in the series being adjacent and of opposite sense. The windings then may be of a fractional number of turns, but preferably comprise one or more turns. An approximately integral number of turns is convenient and about one turn is particularly so, since with just one turn per winding, if the turns are wound closely, the windings in the series can be brought close together, thus increasing the interaction between adjacent windings.

The windings may be coupled to a flux-concentrating core which may be of soft ferromagnetic material, material of high dielectric constant, a non-magnetic conductor or a suitable combination. In the case of a cylindrical structure the core may conveniently be longitudinally disposed within the structure.

In another form of the invention the windings comprise a first helical winding extending along the length of the structure and a second helical winding extending along the length of the structure, the first and second windings having approximately the same number of turns as each other but in the opposite sense.

The antenna according to the invention can be connected into a circuit in the same way as a conventional monopole antenna. That is to say it may be connected by means of a tapping connection or directly at one end. It is found in practice that antennae according to the invention can be made which present suitable impedances for matching to connections made at the end, without any need for tapping connections.

The arrangement of the conductor is such that a resonant antenna according to the invention is physically shorter than a conventional whip antenna resonant at the same frequency. The coupling of the conductor with the core tends further to reduce the necessary length of the antenna. Antennae according to the invention have been found to have a somewhat lower gain than conventional whip antenna, but it has been found that a single extra radio-frequency amplification stage will adequately compensate for this. It is considered that the advantages of compactness and robustness possessed by the antennae herein described outweigh the disadvantages of the lower gain.

It appears that the antennae herein described have the additional advantage that their performance is less sensitive to the proximity of other objects such as walls, furniture, vehicle bodywork or human bodies than conventional whip aerials.

Within the scope of the present invention there is included a radio antenna having a resonant frequency in the VHF band, and comprising an extended conductor, one end of which is an open-circuit end and the other end of which forms an electrical connection to the antenna, forming a series of groups of turns around and disposed along the length of a core formed from a conducting material or a magnetically soft ferromagnetic material, successive groups in the series being wound in left-hand and right-hand senses alternately (i.e., having opposite "chirality").

The core may consist of beads of ferrite or like material to impart a degree of flexibility to the antenna.

It will be appreciated that the windings in antennae according to the invention are so arranged that axial magnetic fields through the windings due to electric currents in the windings substantially cancel.

Antennae according to the invention may be combined to form dipole antennae, but where compactness is particularly required a monopole antenna is generally more convenient.

Some embodiments of the invention will now be described by way of example with reference to the accompanying drawings of which:

Figure 12:
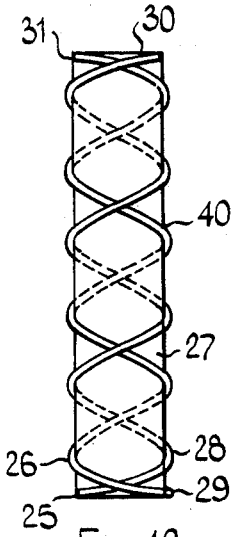
FIG. 12 shows a further radio antenna in accordance with the invention.
Figure 14:
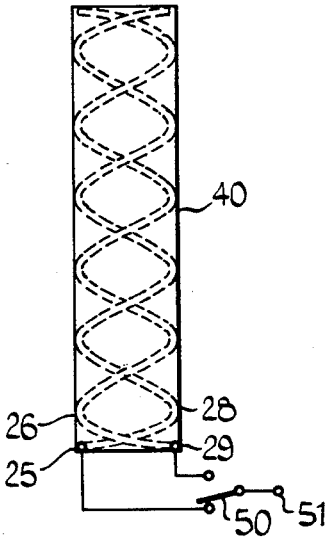
Figure 15:
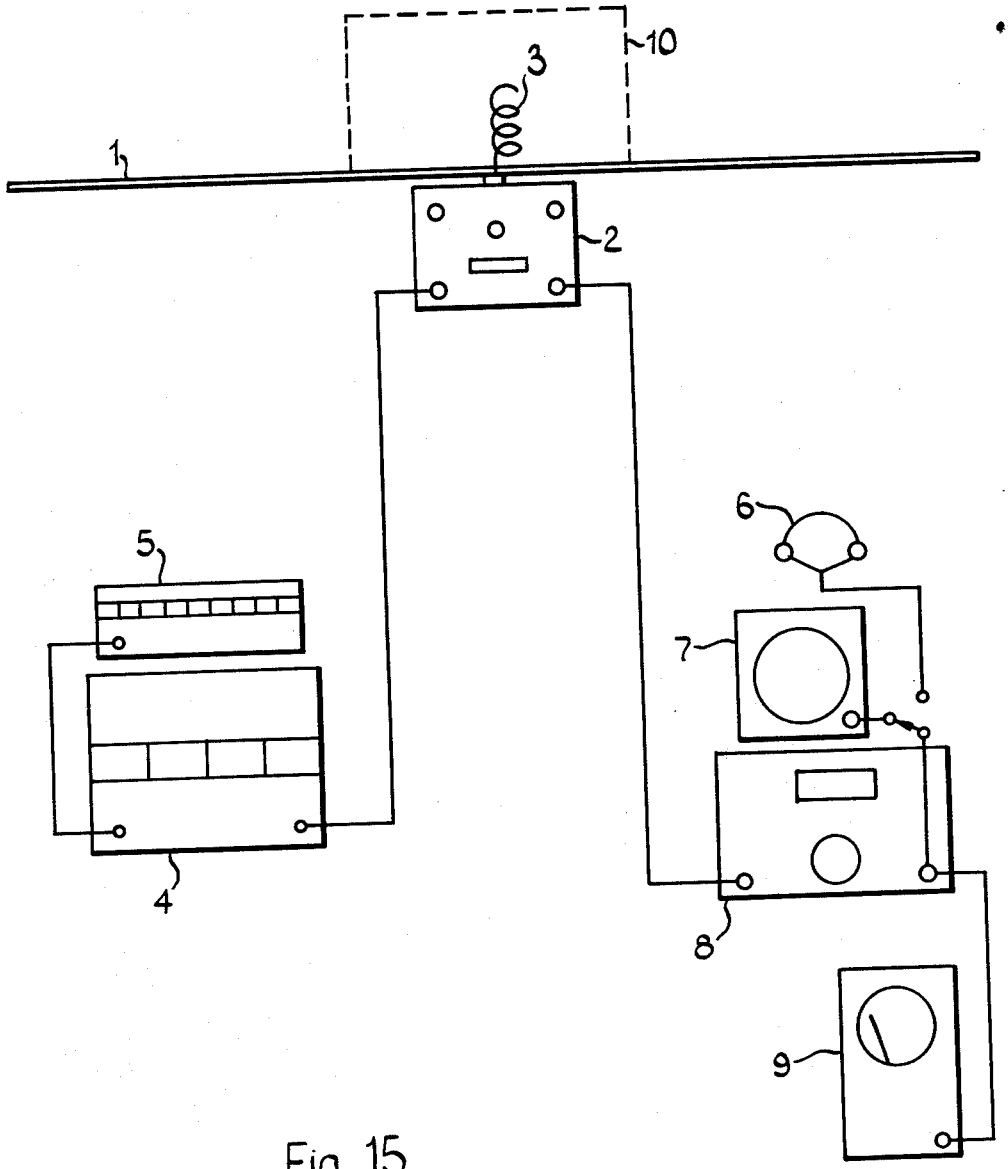
Figure 16:
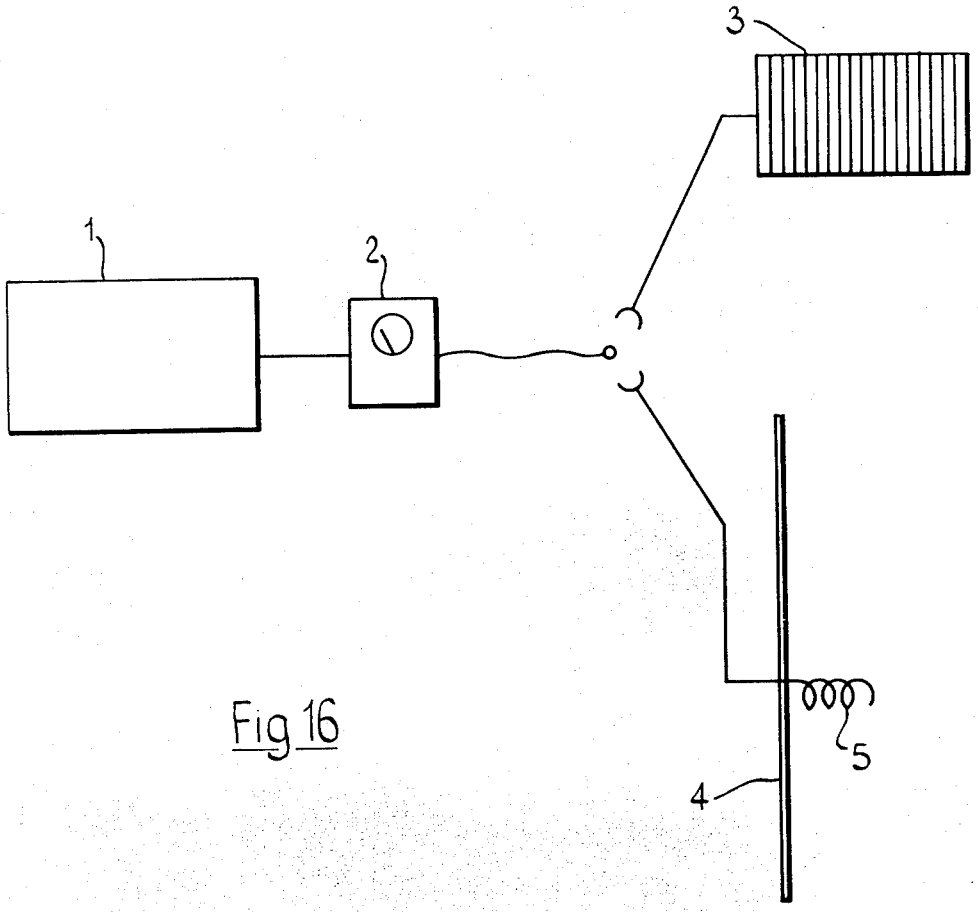
Figure 17:
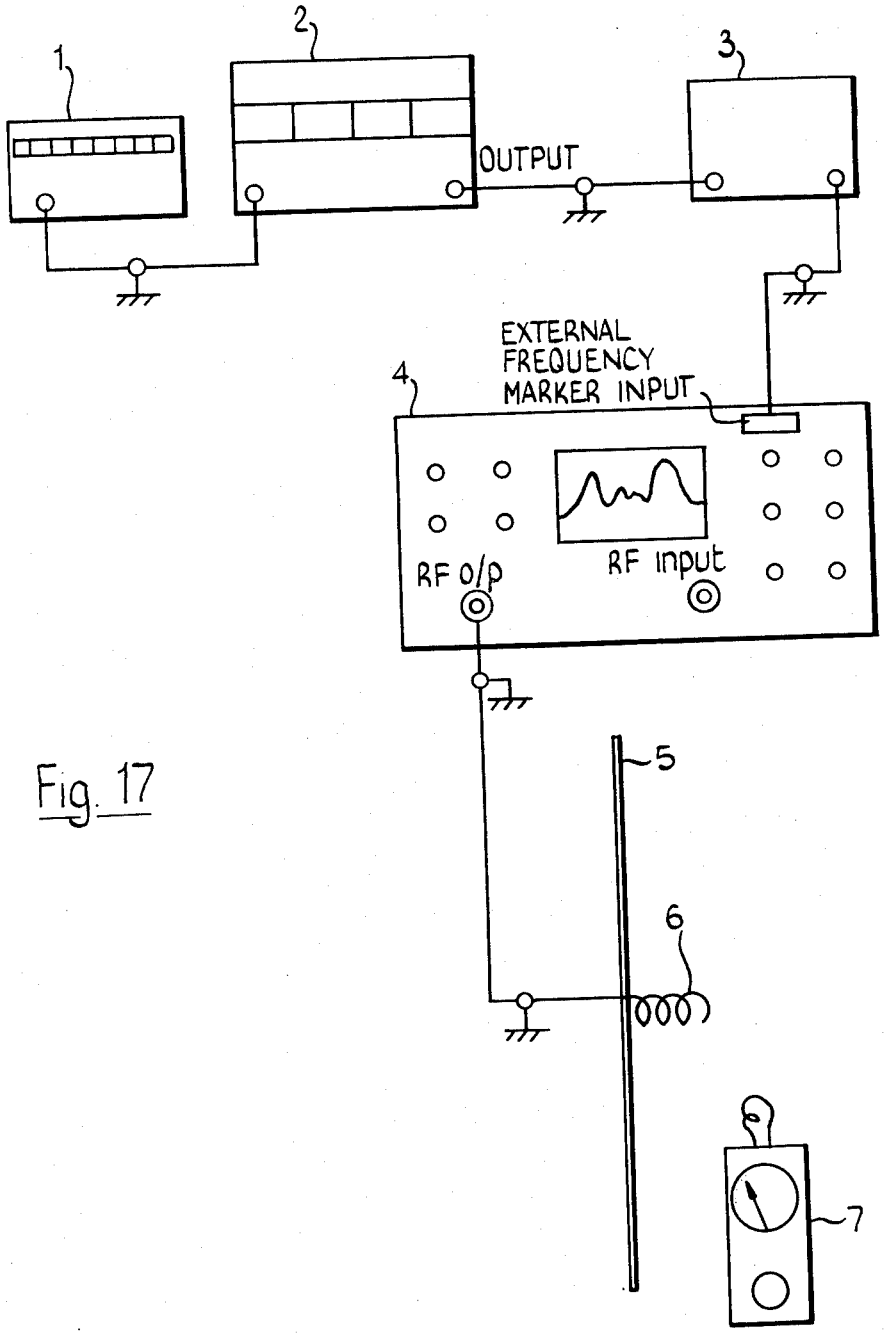
Figure 18:
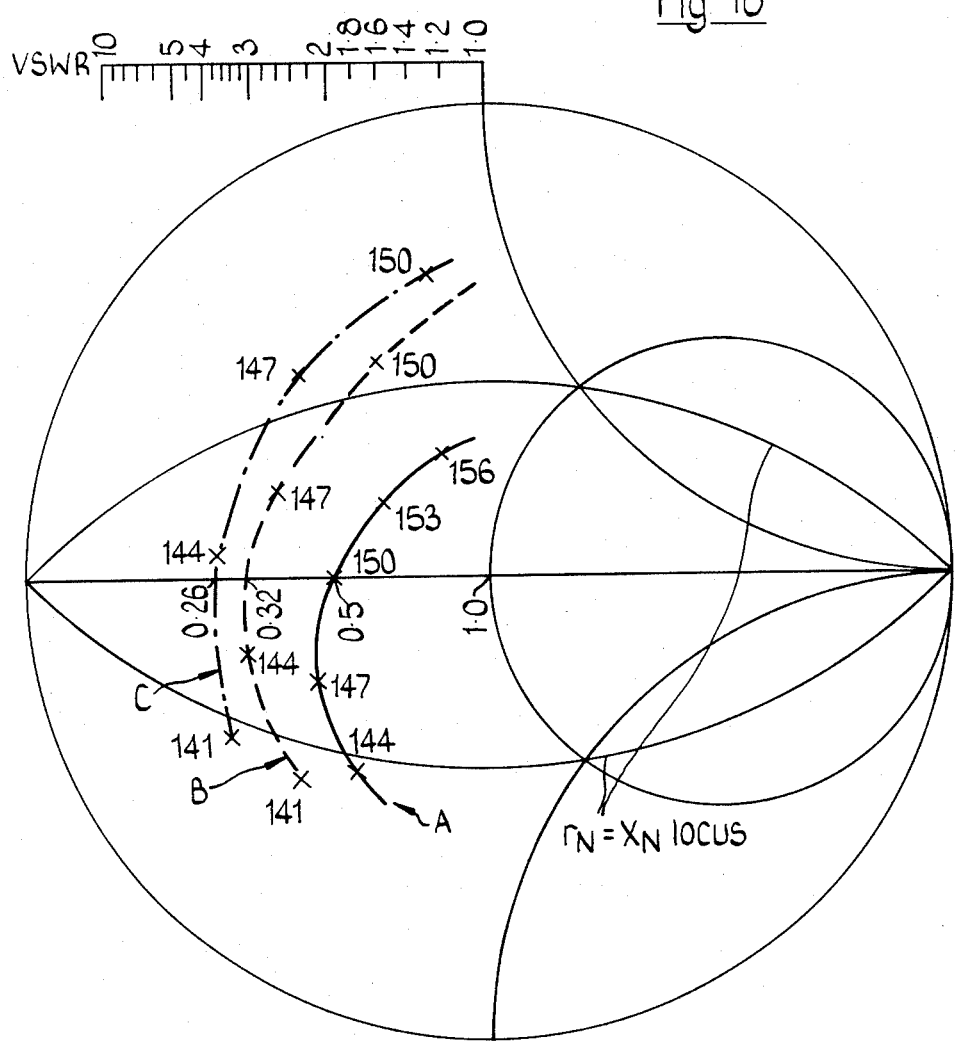
Figure 22:
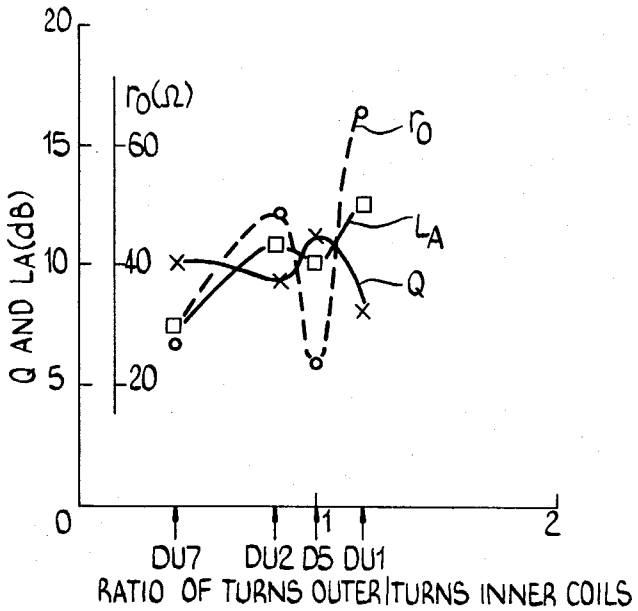
Figure 22:
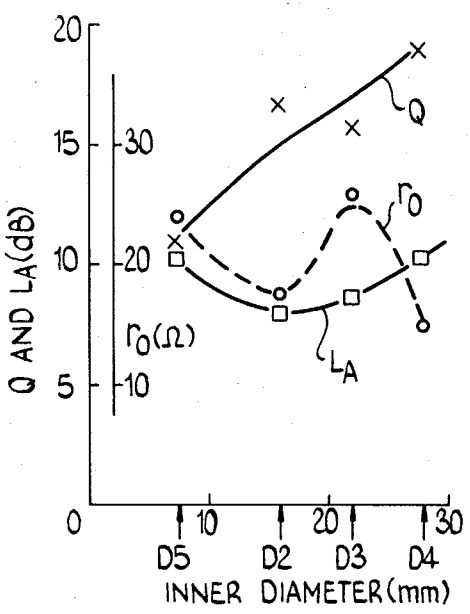
Figure 23:
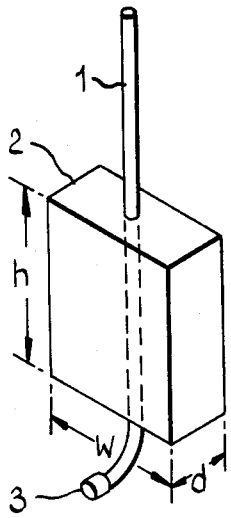
Figure 24:
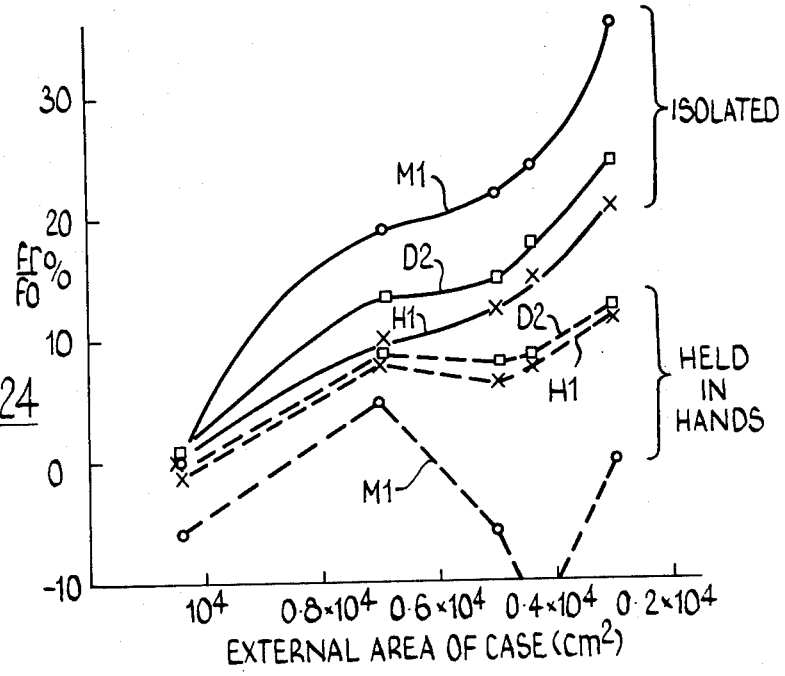

FIG. 14 shows a radio antenna which is similar to that shown in FIG. 12 but with different terminals, FIG. 15 is a diagram of a test rig for antenna admittance and impedance measurements, FIG. 16 is a diagram of a test rig for testing antenna RF power handling capacity, FIG. 17 is a diagram of a test rig for finding antenna resonant frequency, FIG. 18 is a Smith chart showing antenna impedance, FIGS. 19*a*, 19*b* and 20*a*, 20*b* are graphs and associated Smith charts giving characteristics of a helical antenna and doublewound antenna respectively, FIGS. 21*a* and 21*b* show Smith chart presentations of doublewound antenna, FIG. 22*a* shows a graph of internal diameter of winding variation versus Q and LA for two doublewound antennae; and FIG. 22*b* shows a graph of turns ratio of inner and outer windings versus Q and LA for doublewound antennae, FIG. 23 indicates a dimensional notation for a metal transceiver case and antenna, FIG. 24 is a graph showing the percentage change in antenna resonant frequency from resonant frequency as a function of area of small ground planes for various antennae.

Figure 1:
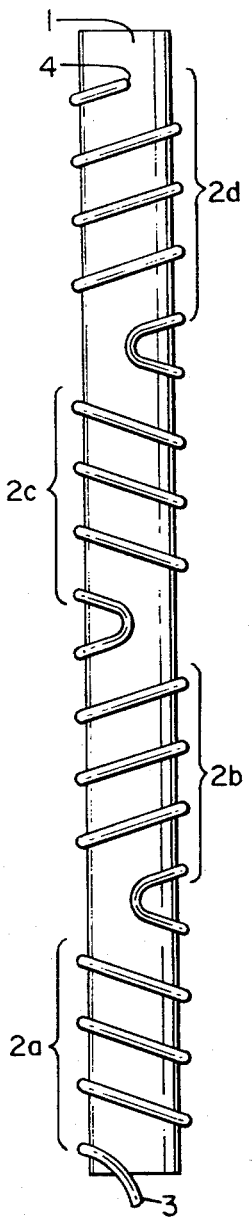
FIG. 1 shows a radio antenna according to the present invention.

In FIG. 1, a ferrite rod 1 has a length of enamelled copper wire wound round it in four groups of turns, 2*a*, 2*b*, 2*c* and 2*d*. The groups 2 are evenly spaced along the length of the rod 1. The group 2*a* consists of four turns in the left-hand sense; the group 2*b* consists of four turns in the right-hand sense; the group 2*c* consists of four turns in the left-hand sense; and the group 2*d* consists of four turns in the right-hand sense. One end of the wire 3, provides an electrical connection for the antenna, and the other end 4, is an open circuit end.

The antenna acts as a quarter wave monopole at a frequency in the VHF band. In order to obtain an antenna tuned to a desired frequency, wire is wound round the rod 1, forming more groups of turns than is necessary, and the resonant frequency is gradually increased by successively clipping off turns from the open circuit end 4 of the wire. When the desired resonant frequency is nearly reached the turns are stretched out to fill the length of the rod 1, whereupon the resonant frequency falls a little.

One such antenna which has been tested, is wound on a ferrite rod 200 mm (9 inches) long and comprises four groups each of four turns, as shown in the Figure. Another antenna which has been tested is wound on a ferrite rod 130 mm long (5 inches). A 200 mm antenna has a bandwidth of about 5 MHz, and has been tried at an operating frequency of 79 MHz on a portable walkie-talkie transceiver. The 130 mm antenna has a similar bandwidth and has been tested on a portable VHF radio receiver using BBC transmissions (about 94 MHz). When tested in the laboratory over a large ground plane, or when mounted on the top of a vehicle, so that the top of the vehicle forms a large ground plane, the antennae according to the invention show a markedly lower gain than a whip aerial adapted to work at the same frequency, and standing over a large ground plane. In subjective tests, however, using portable radio apparatus, in which there is no large ground plane, the antennae according to the invention gave apparently comparable performance with a whip aerial. The sensitivity is definitely lower than with a whip aerial, but it is found that a single extra stage of radio frequency amplification is enough to make the performance subjectively very similar. The ferrite rods used were salvaged from old longwave/medium wave radio receivers and were thus not specially adapted for use at VHF frequencies. An antenna has been tested using a core of dustiron, though to be better adapted for use at VHF frequencies, but the performance was not apparently better than with a ferrite core. An antenna has also been tried using an aluminium tube, of the type used in building dipole antennae of a conventional type, in place of the ferrite rod 1. This antenna worked, but was rather less satisfactory than the ferrite antenna.

Figure 2:
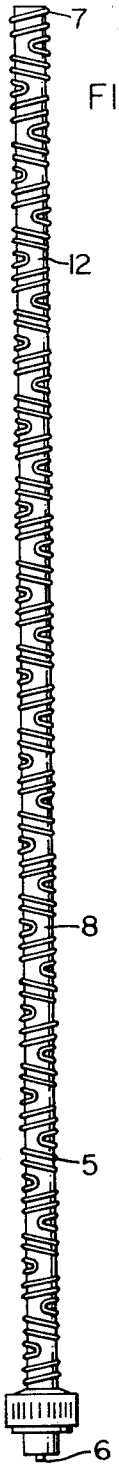
FIG. 2 shows a semi-flexible antenna according to the invention.
Figure 3:
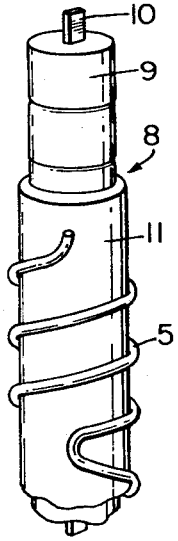
FIG. 3 shows a cutaway view of a portion of the antenna in FIG. 2.

In the antenna illustrated in FIGS. 2 and 3 the conductor consists of thirty-three groups, each of three turns, of enamelled copper wire 5. One end of the wire is connected to the central electrode of a coaxial connector 6 (FIG. 2 only). The other end of the wire 7 is an open circuit end. The core 8 consists of ferrite beads 9 (FIG. 3 only) of the type commonly used as parasitic suppressors (Q-killers) threaded on a strip of fibreglass 10 (FIG. 3 only). The beads are covered by a heat-shrink sleeving to provide protection and added mechanical support. The core 8 extends for only two thirds of the length of the antenna, its place being taken for the third of the length nearest to the open circuit end 7 by a length of plastic tubing 12 whose sole purpose is to provide mechanical support for the windings. The length of the antenna is about 250 mm (10 inches) and the diameter is about 6 mm ($\frac{1}{4}$ inch). The antenna of FIG. 2 has been tested with a portable VHF receiver using BBC VHF transmissions (about 90 MHz). The performance was comparable with, but noticeably less good than the telescopic aerial supplied with the set, but with a single extra stage of radio frequency amplification, subjectively similar performance was obtained. An antenna similar to that of FIG. 2 has been built and made to resonate at 450 MHz. This antenna had fourteen groups, each of one turn, and the length of the antenna was 65 mm ($2\frac{1}{2}$ inches) of which the core only extended for 40 mm ($1\frac{1}{2}$ inches). The antenna of FIG. 2 has quite marked directional properties, and it is notable that in this respect it resembles a rod monopole aerial. I is thus clear that the antenna of FIG. 2 is acting as a monopole antenna, rather than as a magnetic pick-up which conventional ferrite rod aerials are.

Figure 4:
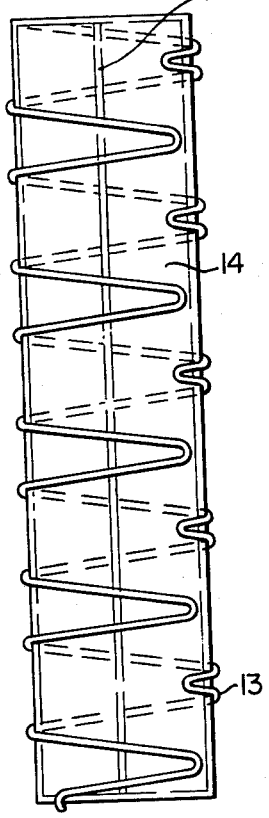
FIG. 4 shows an antenna according to the invention with a dielectric core.

In the antenna of FIG. 4 the conductor 13 is disposed in ten groups, each of one turn, wound alternately in the left-hand and right-hand senses. The core is a dielectric core 14 consisting of distilled water contained in a cylindrical plastics container. A conducting copper wire 15 runs through the axis of the core from one end to the other. The antenna will work without the conductor 15, but the insertion of the conductor 15 lowers the resonant frequency of the antenna, or, for the same frequency, reduces the length of the antenna. The antenna is about 130 mm (5 inches) in length by about 30 mm (about 1¼ inches) in diameter. It has been tested with a portable VHF receiver using BBC broadcasts. The electrical connection is to one end of the conductor 13, the central conductor 15 being left floating.

Figure 5:
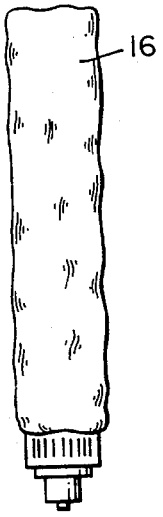
FIG. 5 shows an antenna according to the invention with a dielectric coating.

FIG. 5 shows an antenna with a ferrite core, of a similar type to the antenna of FIG. 1, coated with Plasticine (the word Plasticine is a trademark of Harbutt's Plasticine Ltd). The Plasticine 16 is pressed into the antenna, filling in the air spaces between the turns. The Plasticine acts as a dielectric and lowers the resonant frequency of the antenna, or, for the same resonant frequency, reduces the necessary size of the antenna.

In the antennae thus far described there are loops of wire formed where the conductor turns back on itself between groups of turns. These loops of wire are vulnerable to displacement unless secured in place, and give rise to difficulties in production, especially where many groups of turns are required. In the mode of construction illustrated in FIG. 6 a fibreglass strip 17 extends axially along the length of the antenna and the loops 18*a* to 18*h* are formed round the strip 17. The strip 17 thus serves to hold the loops 18 in place and also acts as a guide in making the loops, enabling them to be neatly in line. In FIG. 7 is shown a section of an antenna constructed in the mode illustrated in FIG. 6 in which the windings are closed up together so that there is virtually no air space between adjacent windings. With antennae according to the invention which do not have any core, it is advantageous that the windings should be as close to one another as possible. In these circumstances the strip 17 is of particular usefulness because there are many loops and they are close together.

Figure 8:
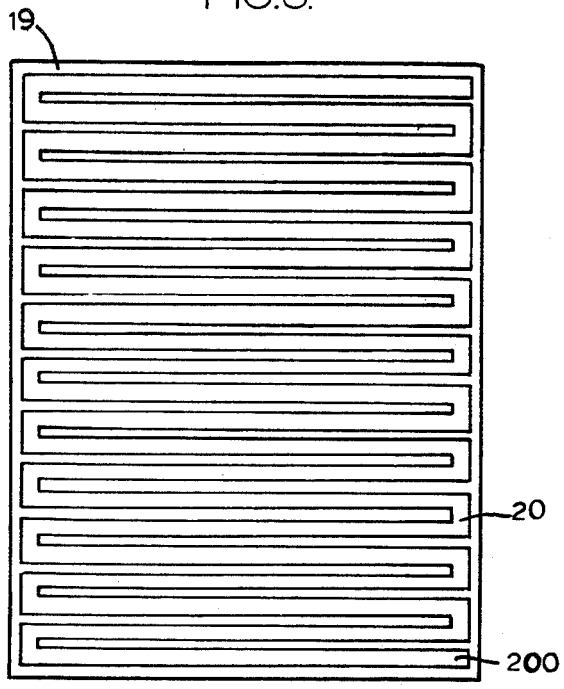
FIGS. 8 and 9 illustrate an alternative mode of construction using a printed conductor.
Figure 9:
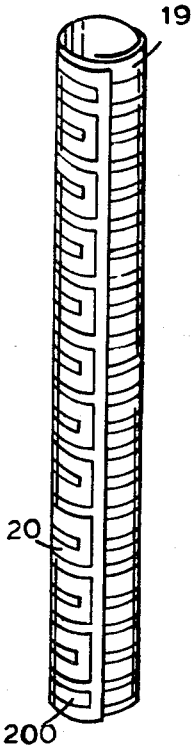

An alternative mode of construction is illustrated in FIGS. 8 and 9. FIG. 8 shows a rectangular sheet of flexible insulating material 19 on which is printed a serpentine conducting strip 20. In FIG. 9 the sheet 19 is shown rolled into a cylinder so that the conducting strip 20 is formed into a series of windings of alternating sense, thus forming an antenna according to the invention. As illustrated in FIG. 9 the windings are each of about two turns, but clearly the windings can be made with any desired number of turns by rolling the sheet more or less tightly.

Figure 10:
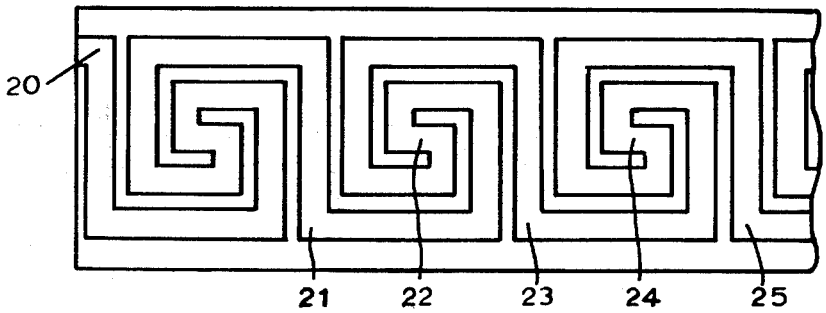
FIG. 10 shows an alternative form which the windings may take.

In all the antennae described so far the axes of the windings have been parallel to the general direction of extension of the antenna. In FIG. 10 is illustrated a form of winding in which the axes of the windings are at right angles to the general direction of extension. As illustrated in FIG. 10 the general direction of extension of the conductor is from left to right. From a point 21 the conductor spirals inwards anti-clockwise to a point 22 and then spirals outwards to a point 23 which is displaced from the point 21 in the general direction of extension of the conductor. From the point 23 the conductor again spirals inwards to a point 24 and then outwards again to a point 25, and so on, repeating the same pattern to form a series of double spirals extending in the general direction of extension of the conductor. In this form of conductor the anti-clockwise spiral from 21 to 22 is one winding and the clockwise spiral from 22 to 23 is the next. The next anti-clockwise spiral from 23 to 24 is the next winding and the clockwise outward spiral from 24 to 25 is the next after that. Thus the conductor forms a series of windings, successive windings in the series being adjacent and of opposite sense.

In field tests of a ferrite cored antenna of the type illustrated in FIG. 1 using walkie-talkie transceivers operating at 79 MHz it was reported that the antenna worked particularly well, compared with conventional whip aerials, in an indoor location and aboard vehicles. It is thought that this may be partly due to the physical convenience of having a compact antenna in confined spaces. This is particularly so within vehicles where the whip aerial normally used had to be pushed out through a window in order to make room for the occupants of the vehicle to ride in any comfort. It is also, however, thought to be partly due to the smaller near field of the antennae according to the invention, compared with whip aerials, which makes the antennae according to the invention less vulnerable to so-called proximity effects, by which conventional whip aerials are pulled out of tune by the presence of nearby objects.

Figure 11:
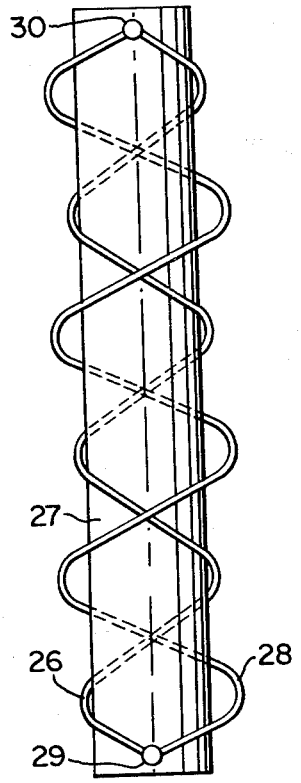
FIG. 11 illustrates an antenna according to the invention.

FIG. 11 shows schematically a further antenna according to the invention. A first helical winding 26 of insulated copper wire is wound around a cylindrical former 27. A second helical winding 28 of insulated copper wire is wound over the first winding 26. The two windings 26 and 28 are joined together at one end, 29, which forms the connection to the antenna, so they effectively constitute a single conductor. As illustrated the windings 26 and 28 are also joined together at the other end 30. This is convenient since it helps to prevent the windings from coming unwound, but it makes practically no difference to the operation of the antenna. The windings 26 and 28 are coaxial, have the same longitudinal extent and number of turns but are wound in the opposite sense, the first winding 26 being illustrated as left-handed and the second winding 28 as right-handed.

For the sake of clarity the windings are shown loosely wound and the second winding 28 is shown standing out well clear of the first winding 26. Also only a small number of turns are shown. In an embodiment of the antenna which has been built and tested the windings 26 and 28 were closely wound, leaving substantially no gaps between turns, and the second winding 28 was wound directly over the first winding 26, with substantially no space between them. The antenna measured two meters in length and 25 mm in diameter and the windings were closely wound in 32 gauge wire. The antenna was resonant at 7.4 megahertz (in the HF band) with a bandwidth of about 2.5 megahertz. The impedance at the point 29 was about 200 ohms, which could easily be matched to 50 ohm equipment by means of a small autotransformer. For comparison a helical whip antenna resonant at 7.4 megahertz of similar dimensions was made. The bandwidth of the helical whip antenna was only about 250 kilohertz and there were strong multiple resonances. The antenna according to the invention had a fairly strong half-wave resonance at 15 megahertz, but no strong higher resonances.

Figure 6:
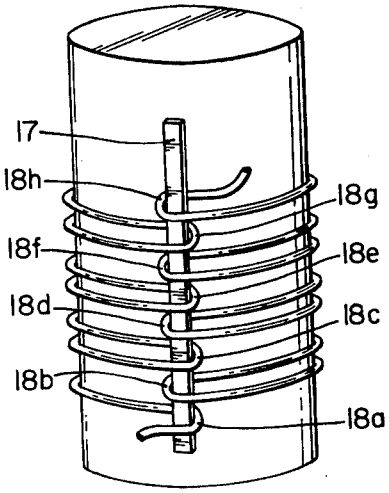
FIGS. 6 and 7 illustrate a mode of construction of antennae according to the invention using a wire conductor.
Figure 7:
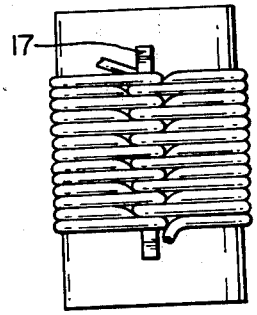

An HF antenna resonant at 7.4 megahertz has also been built using the mode of construction illustrated in FIGS. 6 and 7. The antenna was one meter long and 65 mm in diameter and comprised a series of windings, each of one turn, closely wound in 32 gauge wire. The performance was similar to that of the antenna constructed as illustrated in FIG. 11, but the amount of labour involved in making the windings was much greater.

FIG. 12 shows a further antenna 40 which is similar to that of FIG. 11 in that the antenna has first and second insulated copper wire helical windings, 26 and 28 wound in opposite senses on a cylindrical former 27. However, in the FIG. 12 embodiment only the inner winding 26 is connected to a receiver circuit via a terminal 29 and the outer winding 28 is not electrically connected to winding 26 or any part of a circuit for the antenna. It has been found that antennae of FIGS. 11 and 12 of the same general construction as regards number of turns, diameter of wire and the former 27 dimensions have closely similar performances. Further, it has been found that there is little change in the performance of the FIG. 12 embodiment when the outer winding 25 is connected to the receiver circuit and the inner winding 26 is left unconnected.

Figure 13:
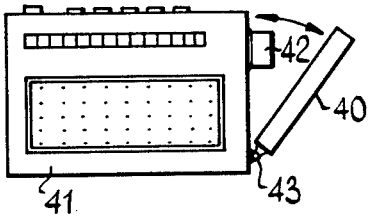
FIG. 13 shows a VHF radio receiver which includes the antenna of FIG. 12.

FIG. 13 shows a VHF radio receiver 41 which includes the antenna 40 of FIG. 12. The antenna 40 is pivotally mounted by means of a ball and socket joint 43 and may be pivoted from a stowed position where it may be held by means of a U-shaped clip 42 to a working position as shown in FIG. 13. Typically such an antenna is between about 100 to 200 mm in length and thus is a convenient length for mounting on portable VHF radios without having to resort to telescopic or folding antennae.

FIG. 14 shows an antennae 40 which has the same inner and outer windings as that of FIG. 12 but has the end 25 of the outer winding formed as a terminal. The antenna is connected via a switch 50 to an input terminal of a radio receiver so that by operating the switch 50, the inner or outer winding can be connected to the receiver to vary the tuning characteristics of the antenna.

FIGS. 15 to 24 relate to experimental work on antennae which are described in the following tables:

TABLE 1

| | ANTENNA DETAILS | | | | | | |
|---|---|---|---|---|---|---|---|
| No | ANTENNA TYPE | $f_o$ (MHz) | Δf (MHz) | $L_A$ (dB) | η ( ) | N | $r_o$ (Ω) |
| M1 | ¼ wave monopole | 150 | ~20 | 0 | 100 | 1 | 25 |
| H1 | Helical | 142 | ~1.5 | 1.04 | 81 | 4.6 | 5 |
| C1 | Counterwound | 150 | ~2 | 0.4 | 90 | 4.15 | 5 |
| D1 | Doublewound | 150 | ~9 | 7.8 | 16 | 5.6 | 21 |
| D2 | Doublewound | 145 | ~7.5 | 7.2 | 19 | 4.1 | 16 |
| D3 | Doublewound | 150 | ~12 | 10.7 | 8 | 5.6 | 32 |
| D4 | Doublewound | 150 | ~10 | ~12 | — | 5.9 | 20 |
| D5 | Doublewound | 167 | ~13.5 | 8.7 | 14 | 3.6 | 20 |
| DS1 | Doublewound spacing | 140 | 3 | 6 | 25 | 5.3 | 10 |
| DD1 | Doublewound (inner only) | 190 | >25 | 6.1 | 24 | 2.3 | 63 |
| DD2 | Doublewound (outer only) | 175 | >30 | 8.4 | 14 | 2.5 | 48 |
| DD3 | Doublewound (outer only) | 175 | >35 | 10.4 | 9.7 | 2.5 | 45 |
| DD4 | Doublewound | 174 | 16 | 4.7 | 33 | 2.5 | 15 |
| DU1 | Doublewound | 166 | 23 | 11.3 | 8 | 4.1 | 60 |
| DU2 | Doublewound | 165 | 20 | 9.8 | 10.3 | 4.1 | 44 |
| DU3 | Doublewound (inner only) | 145 | 15 | 13 | 5 | 4.9 | 50 |

TABLE 1-continued

| | ANTENNA DETAILS | | | | | | |
|---|---|---|---|---|---|---|---|
| No | ANTENNA TYPE | $f_o$ (MHz) | Δf (MHz) | $L_A$ (dB) | η ( ) | N | $r_o$ (Ω) |
| DU4 | Doublewound | 141 | 10 | 7.4 | 18 | 5 | 25 |
| DU5 | Doublewound (inner only) | 153 | 15 | 8.3 | 15 | 4 | 40 |
| DU6 | Doublewound | 147 | 10 | 6 | 25 | 4.1 | 22 |
| DU7 | Doublewound | 186 | 16 | 6 | 25 | 3.8 | 23 |

TABLE 2

| ANTENNA CONSTRUCTION | |
|---|---|
| M1 | ⅛" diameter wire. |
| H1 | 28 turns 19 SWG wire, 9 mm internal diameter, L = 115 mm. |
| C1 | 35 turns 18 SWG wire 9 mm internal diameter, L = 120 mm, 4 turns positive and 4 turns negative alternatively for 7 sections. |
| D1 | 136 turns 24 SWG wire, 16 mm internal diameter, L = 90 mm, identical turns wound on to form outer winding. |
| D2 | 145 turns 22 SWG wire, 16 mm internal diameter, L = 125 mm (excluding BNC plug of 20 mm), identical turns wound on to form outer winding. |
| D3 | 103 turns 22 SWG wire, 22 mm internal diameter, L = 90 mm, outer winding 98 turns only to adjust tuning. |
| D4 | 89 turns 20 SWG wire, 28 mm internal diameter, L = 85 mm (not including plug), outer winding 86 turns only to adjust tuning. |
| D5 | 318 turns 29 SWG wire, 7.5 mm internal diameter, L = 128 mm, 1 identical outer winding. |
| DS1 | 83 turns 22 SWG wire, 6.5 mm internal diameter, L = 100 mm, outer winding of 58 turns 16 SWG on 12.5 mm former to create annular cylindrical air gap. |
| DD1 | 400 turns 29 SWG wire, 6.3 mm internal diameter, L = 172 mm, outer winding 200 turns 22 SWG on top of inner. Inner coil excited only (outer not joined at feed). |
| DD2 | As DD1 but outer coil excited only (inner not joined at feed). |
| DD3 | As DD2 with outer excited and inner connected to outer at the other end to feed point. |
| DD4 | As DD1 but with both inner and outer excited at feed point. |
| DU1 | 282 turns 29 SWG wire, 6.3 mm internal diameter, L = 110 mm, outer winding 340 turns 32 SWG wound directly on top of inner winding. |
| DU2 | 340 turns 32 SWG wire, 6.3 mm internal diameter, L = 110 mm, outer winding 285 turns 29 SWG wound directly on top of inner winding. |
| DU3 | 252 turns 29 SWG wire, 12.5 mm internal diameter, L = 105 mm, outer winding 162 turns 26 SWG wound directly on inner. Inner coil excited only (outer not joined at feed). |
| DU4 | As DU3 but both windings excited at feed point. |
| DU5 | 200 turns 26 SWG wire, 12.5 mm internal diameter, L = 125 mm, outer winding 150 turns 22 SWG wound directly on inner. Inner coil excited only (outer not joined at feed). |
| DU6 | As DU5 but both windings excited at feed point. |
| DU7 | 250 turns 29 SWG wire, 6.3 mm internal diameter, L = 105 mm, outer winding 104 turns 20 SWG wound directly on inner. |

TABLE 3

| Antenna excitation | | | | | |
|---|---|---|---|---|---|
| both coils | inner only | $f_o$ | Q | $L_A$ | $r_o$ |
| DD4 | DD1 | +9% | −30% | +30% | +310% |
| DU4 | DU3 | +2.5% | −33% | +75% | +100% |
| DU6 | DU5 | +4% | −31% | +54% | +20% |

Percentage change in $f_o$, Q, $L_A$ and $r_o$ when only the inner coil is excited.

The following symbols are used in the above tables and in the following text:

| | |
|---|---|
| N | $= \frac{\text{Length of quarter-wave monopole}}{\text{length of small antenna}}$ |
| $L_A$ | = antenna system loss factor |
| $\eta$ | = antenna efficiency |
| $\Delta f$ | = antenna bandwidth |
| G + j b | = antenna admittance |
| j | $= \sqrt{-1}$ |
| $r_N + j X_N$ | = normalised (50Ω) antenna impedance |
| $r_o$ | $= r_r + r_L$ = resistance at resonance |
| $r_r$ | = equivalent antenna radiation resistance |
| $r_L$ | = equivalent antenna internal loss resistance |
| $f_o$ | = frequency of antenna resonance |
| L | = antenna overall length |
| Q | $= f_o/\Delta f$ |

The antennae listed in Tables 1 and 2 had enamelled copper wire windings on lossless cylindrical formers. In some antennae a BNC plug was mounted on the antenna base and in other antennae their feed points were excited by inserting their wire ends into a test rig socket. All the antennae were tested in the vertical position. The inner and outer windings were separated by a layer of 'Sellotape.'

While all the experimental work has been carried out on monopole-like devices on a ground plane the designs could, with suitable excitation, be changed to obtain dipole action with the feed applied centrally. The radiation patterns of all the antennae tested are essentially those of a conventional wire monopole or dipole and thus no patterns are presented although checks have been made to verify the pattern shape.

The types of antennae that have been investigated or used are:

(a) Conventional quarter wave monopole (M)
(b) Conventional helical antenna (H)
(c) Counterwound (C)
(d) Doublewound (D)
(e) Doublewound with spaced coils (DS)
(f) Doublewound with unequal turns and only inner or outer excited (DD and DU)

The term 'counterwound' refers to windings of the configuration shown in FIG. 1 and 'doublewound' refers to windings as in FIG. 11 or FIG. 12. The spacing refers to an annular cylindrical airspace between windings. The helical antenna is included because it is the most common form of small antenna and forms a useful comparison.

At lower frequencies it is not practical to measure the properties of antennae within the laboratory and reliance is put on actual field trials or perhaps system measurements outside. This introduces many unknown propagation effects, matching problems and difficulties of assessing the quality of the received signal. At VHF however it is practical to measure the antenna properties indoors. The parameters of interest are antenna bandwidth $\Delta f$, and the inherent power loss in the antenna when working under matched conditions. The latter is expressed as a system loss $L_A$ or alternatively as an efficiency $\eta$%. The ratio of the height of the small antenna to that of a conventional quarter-wave monopole is defined as N which is taken as $>1$.

FIG. 15 is a diagram of a test rig for antenna admittance and impedance measurements for an antenna 3. A Wayne-Kerr admittance bridge 2 is fed from a signal generator 4 coupled to a frequency counter 5 and out-of-balance signals detected by a radio receiver 8 which has its output connected to a loudspeaker 7 or headphones 6 via a switch, and to an audio output meter 9. The bridge 2 is balanced to yield antenna admittance G+j b. To assess the antenna efficiency by the 'Wheeler Can' method, the admittance is re-measured at each frequency but with a large screening can 10 placed over the antenna. Leakage of radiation between instruments and cables around edges of a ground plane 1 below the antenna 3 was reduced by careful choice of earthing points and screening under the ground plane. The ground plane is continuous and of large enough extent so that at frequencies of interest these conditions were satisfied. The 'Wheeler Can' method can produce erroneous results if the can is either too large or too small. A 0.7 meter diameter cylindrical can of height 0.4 meters which is about the smallest can which gives acceptable detuning effects was used. The value of $L_A$ (dB) had a ±10% error tolerance.

FIG. 16 shows a test rig for checking RF power handling characteristics of antennae and enables incident and reflected powers in the antenna feed to be monitored and may be used to check the operation of a transmitter system which incorporates the antenna. A 150 MHz 0–50 watt RF source is connectable to an antenna 5 on a ground plane 4 and to a 50 ohm dummy load 3, via a wattmeter 2.

FIG. 17 shows a further test rig which enables input impedance properties of an antenna to be obtained as a function of frequency, and gives the resonant frequency and tuning effects with good accuracy but the impedance level is only a qualitative assessment indicating for example well above, well below or near 50 ohms. A Rhode and Schwarz Polyskop meter 4 has its RF output connected to an antenna 6 or a ground plane 5 and the antenna output measured using a grid dip oscillator 7. A frequency meter 1 is connected to an input of a signal generator 2 and the output fed to an external frequency marker input of the meter 4 via an amplifier 3.

The admittance G+j b read from test rig shown in FIG. 15 was converted to a normalised impedance $r_N + jX_N$ with respect to 50Ω. G was read directly in mhos from the Wayne Kerr Bridge but B had to be converted from the capacity reading of Cpf which could be +ve or −ve.

$$r_N = \frac{1}{50}\left(\frac{G}{G^2 + B^2}\right), \quad X_N = -\frac{1}{50}\left(\frac{B}{G^2 + B^2}\right)$$

$$B = 2\pi f C\, 10^{-6}$$

where f=frequency. The results were computer processed and then plotted on a Smith chart of which a typical example is shown in FIG. 18. Antenna efficiency was calculated by noting the value of the antenna resistance at resonance, both with and without the Wheeler can. Let $r_r$ and $r_L$ denote the equivalent radiation and loss resistance of the antenna at resonance then it follows that $$\eta = \frac{r_r}{r_r + r_L} \times 100$$

$$L_A = 10 \log_{10}\left(1 + \frac{r_L}{r_r}\right) dB$$

For the example in FIG. 18 we have $$r_r + r_L = 0.32 \times 50\Omega$$

$$r_L = 0.26 \times 50\Omega$$

giving $\eta=18.75\%$ and $L_A=7.2$ dB.

The bandwidth of an antenna depends on its input impedance characteristic and also the impedance of the transmitter or receiver. The former can be read directly from the Smith chart and if the frequency at which $r_N=X_N$ sets the limits of the bandwidth this is readily given by the locus of $r_N=X_N$ on the chart. In practice however the antenna impedance would be transformed in some way to the desired impedance level which was taken as 50Ω. A circle delineates a region of operation whereby a resulting input VSWR is less than a given value. The radius of the circle for various VSWR values is indicated on the chart. As electrical transformation networks for the antennae are not precisely known, the VSWR circles are centred about the antenna resonance point which presupposes that the curves will not change too much under transformation. The bandwidth assessments are therefore taken as an approximate average of both the '$r_N=X_N$ and 'VSWR circle' methods as appropriate, to obtain a realistic appraisal.

Referring to FIG. 18 and FIG. 15 the conventional quarterwave wire monopole M1 exhibited a lower input resistance $r_o$ than was expected which indicates the effect of wire connections which were used between a measurement socket in the ground plane 1 and the measurement bridge 2. Proximity effects due to distant walls etc also made some small contribution to this. The helical (H1) and counterwound (C1) antennae were similar in characteristics exhibiting very low input impedances; curves for H1 are given in FIG. 19 and the usefulness of the Polyskop trace is evident since it provides, by comparison with the bridge a very quick measurement.

Antenna characteristics of doublewound antennae with different diameters were investigated. This was done by using thicker wire for larger diameters but it was not possible to keep the precise N value throughout. Impedance curves for D2 with and without the Wheeler can are given in FIG. 18 and are fairly typical of the antennae in this test. It was found with this series of antennae that one of the windings in complete isolation from the other resonates at a wavelength which is between 8 to 10 times greater than that of the doublewound configuration. Thus a 150 MHz doublewound antenna resonates around 20 MHz when the outer winding is removed and is a useful guide to the number of turns required.

Clearly the additional wire used above that for a conventional helical antenna increases antenna losses and consequently the bandwidth and input impedance. The question then arises as to whether the counterwound antenna bandwidth can be obtained by simply damping down a helical antenna. It was evident however from the previous experiments that double humped bandpass input characteristic can be obtained by varying the turns ratio and coil spacing. Additional bandwidth can be acquired by coupling turns in opposition. Increased bandwidth is not just due to additional losses as maybe judged by comparing actual loss values. For example D2 has about five times the bandwidth of H1 yet the $r_o$ value has increased from only 5Ω to 16Ω which is approximately 3:1.

Antenna DD was measured with four configurations of winding connections and the results are shown in FIGS. 20 and 21. The bandwidth and losses can be changed in a ratio of about 2:1 by exciting either one or the other coils or both. Antenna DD3 is very wideband but at the expense of high loss but DD1 on the other hand has improved characteristics over DD4 with little extra loss.

The series of antennae DU1–7 were used to investigate the effect of unequal turns for various diameters. The response curves are similar in shape to those of DD1–4 and the results are summarised in Table 1. Antenna DU1 has more turns on the inner coil while DU2 has more turns on the outer. The latter gives a lower input resistance $r_o$ and $L_A$ value. Antennae DU3–6 are for larger diameters and different lengths, and include tests on exciting the inner coil only. Finally DU7 is a compromise between the turns and diameters previously tried. It appears that the tuning shifts upward if only the inner winding is connected while tuning is not affected much by exciting only the outer winding whereas the other parameters change.

FIG. 22*a* illustrates how the changes in antenna parameters relates to the diameter of the plastic former for antennae D2 to D5. As somewhat different N values were used in each case the curves have been adjusted by scaling the parameters in the ratio of the N value to an average figure of 4.5 at about $f_o=150$ MHz. The resistance $r_o$ is a sensitive parameter but lies scattered between 15 and 25Ω with no discernible trend. The Q value on the other hand increases with diameter inferring that a small diameter is to be preferred but then the loss factor $L_A$ appears to be minimum for moderate diameters; D2 is on the whole an optimum choice. The trend curves of FIG. 22*b* reveal the large change in characteristics that are brought about by unequal turns and these curves are again scaled to approximately adjust for the different N values used by using N=4.5 at 150 MHz. Q and $L_A$ vary much less than $r_o$ about the unity ratio condition so this could prove a useful technique for adjusting the input resistance. It could however make the antenna sensitive to production tolerances if the design was critical. It appears that the Q is consistently reduced by about 30% and the frequency of resonance raised by between 2.5 and 9%; $L_A$ and $r_o$ also increase but no other trend is apparent. This technique appears to provide a means of obtaining more bandwidth from a doublewound antenna at the expense of increased loss; the increase in $r_o$ may offset the increased loss factor in some systems however if a better match is obtained.

An N value of between 4 and 5 is suitable and at 150 MHz a diameter of between 10 and 20 mm appears optimal for a doublewound coil with equal turns and both coils excited, with a length to diameter ratio of between 12:1 and 6:1.

A design procedure which was adopted was to choose N and a diameter within the above recommended range and select a wire gauge that permits enough turns to be wound on to obtain resonance. After adding the identical outer coil the characteristics are measured and if increases in $r_o$ are required the turns ratio are made slightly different from unity. The ratio can be greater or less than unity to give an increase in $r_o$. Finally if more bandwidth is required then only the inner need be excited and the outer coil is then left in position but disconnected at the base. A comparison of D2 and DU6/DU5 indicates that where unequal turns are used and only the inner is excited then both higher bandwidth and $r_o$ are obtained for a 54% increase in $L_A$.

A commercial VHF radio (Fidelity Radio LTD) was fitted with a doublewound antenna of length 130 mm instead of the conventional pull-up whip antenna which is typically about 6 to 7 times longer. The above design procedure was followed and 295 turns of 26 SWG were wound on a 16 mm former and the same number of turns were wound directly on top to make the outer winding. A layer of 'Sellotape' separated the windings. The antenna tuned to 85 MHz and the input resistance $r_o$ was around 40Ω according to the Polyskop response. No admittance measurements were made and it is assumed that the results at 150 MHz gave a good guide to behaviour at 85 MHz. The antenna was placed horizontally and at right angles to the radio case. User tests showed little difference between the reception with the small antenna, as compared to that with a 600 mm pull-up whip. This assumed that the antenna was suitably oriented but this presents a problem if the antenna is fixed to the set. Attempts were made to place the antenna completely inside the set in close proximity to the radio circuitry but the reception was impaired. This was examined by placing circuitry against the antenna when connected to the Polyskop and it was found that both detuning and damping effects occurred. In one experiment the detuning was allowed for by rewinding the antenna to suit but the damping effects continued to impair the reception.

A small antenna in accordance with the invention is less prone to detuning effects produced by objects within a housing because a conventional pull out whip antenna has a radius of reach five or six times greater than the small antenna.

A small antenna in accordance with the invention may be used on a domestic VHF set with a loss of signal strength as little as 2–4 dB which can be made up for by increasing radio gain. In particular tests confirm that the antenna needs to be freely mounted both to avoid damping by the set and to allow orientation in weak signal conditions.

Helical antennae are extensively employed on portable transreceivers but their narrow bandwidth and very low impedance characteristics as illustrated by antenna H1 create both design and operational problems. By comparison the doublewound technique offers stable wideband operation with an opportunity of matching more directly to the transmitter which in turn can make up for the additional system loss $L_A$. System loss on an infinite ground plane and also the relative sensitivity of the doublewound and helical antennae on small ground planes were investigated. Antenna D2 was connected to a receiver and its VSWR using the test rig of FIG. 16 was about 2:1 at 145 MHz. On allowing for this mismatch, the antenna system loss above that of a matched quarter-wave monopole was between 3 and 7 dB thus agreeing in order with the measurements of $L_A$ in Table 1. In these tests a 2 ft diameter ground plane was used.

For the small ground plane tests several metal boxes with open ends were constructed and their rectangular shape was proportioned to resemble that of typical portable transreceivers. The dimensions of the transreceivers were as follows:

TABLE 4

DIMENSIONS OF METAL CASES USED AND MEANS OF CONNECTION TO POLYSKOP

| CASE No | HEIGHT h (mm) | WIDTH w (mm) | DEPTH d (mm) | ANTENNA SURFACE AREA $cm^2$ |
|---|---|---|---|---|
| 1 | 242 | 190 | 62 | 12200 |
| 2 | 160 | 130 | 62 | 690 |
| 3 | 140 | 110 | 50 | 500 |
| 4 | 152 | 90 | 42 | 440 |

TABLE 4-continued

DIMENSIONS OF METAL CASES USED AND MEANS OF CONNECTION TO POLYSKOP

| CASE No | HEIGHT h (mm) | WIDTH w (mm) | DEPTH d (mm) | ANTENNA SURFACE AREA $cm^2$ |
|---|---|---|---|---|
| 5 | 120 | 83 | 32 | 300 |

A coaxial lead was connected to an antenna socket 3 on one end of each case as shown in FIG. 23 so that the impedance characteristic as a function of frequency could be displayed on the Polyskop. Antennae D2, M1 and H1 were used in the tests whereby the antennae were measured on each of the boxes in turn. The shift of frequency brought about by the effect of a small ground plane is shown in FIG. 24 for each box.

Monopole M1 is very sensitive to the ground plane size and presumably the shape. Large frequency changes can be obtained by varying the position of the hands. The test in isolation was done by supporting the case on polystyrene foam. By comparison the small antennae were very stable with the helical antenna showing less frequency shift. However the Q of the helical antenna is some five times greater than the Q of the doublewound and the latter is therefore the most stable in operation. This useful experiment shows the benefits of small antennae when used in conjunction with a small ground plane.

The illustrated embodiments of the invention are not intended to provide an exhaustive catalogue of possible embodiments, and a person skilled in the relevant art will be able to produce others. For example the antennae can be made shorter and wider, and other core materials can be used. For example, distilled water was used as a dielectric because of its easy availability and convenience in a laboratory context, but for practical production purposes, other known dielectrics may well be more convenient and more effective. For example, rutile type dielectrics are known which have higher dielectric constants than water at VHF frequencies and have very low losses. Also titanate ferro-electric dielectric materials have very high dielectric constants, but they have comparatively high losses, and their properties are temperature dependent to an undesirable degree.

I claim:

1. An end fed radio antenna comprising first and second extended conductors each having an electrical length of one quarter of the design wavelength and each disposed in helical, insulated windings being of opposite chirality, wherein the conductors are mutually coaxial and longitudinally co-extensive and wherein one pair of adjacent ends of the conductors are connected to each other to form the end feed of the antenna.

2. An end fed radio antenna comprising first and second extended conductors each having an electrical length of one quarter of the design wavelength and each disposed in helical, insulated windings of plural, closely wound, turns, the helical windings being of opposite chirality, wherein said first conductor is coaxial and longitudinally co-extensive with said second conductor, and wherein said first conductor has one end which comprises the end feed of the antenna.

3. An end fed radio antenna comprising first and second extended conductors each having an electrical length of one quarter of the design wavelength and each disposed in helical, insulated windings of plural, closely wound, turns, the helical windings being of opposite chirality, wherein said first conductor is coaxial and longitudinally co-extensive with said second conductor, a feed terminal, and a switch for connecting said terminal to either or both of said first or second conductors.

4. An end fed radio antenna comprising a pair of extended electrical conductors each having an electrical length of one quarter of the design wavelength and each disposed in helical, insulated windings, the windings being of the same diameter and of opposite chirality, wherein the conductors are coaxial and longitudinally co-extensive and wherein one terminal end of at least one of said pair of conductors comprises the end feed of the antenna.

5. An end fed radio antenna as in claim 1 or claim 9 further including a flux-concentrating rod coaxial with end extending through said helical windings.

6. A VHF radio including a radio circuit housing and an end fed antenna as in claim 1 or claim 4 wherein said antenna is pivotally supported at its feed end on said housing, said antenna being angularly displaceable between a housed position and a working position.

7. A VHF radio including a radio circuit housing and an end fed antenna as in claim 5 wherein said antenna is pivotally supported at its feed end on said housing, said antenna being angularly displaceable between a housed position and a working position.

8. An end fed radio antenna as in claim 5 wherein said flux-concentrating rod is composed of ferrite material.

9. A VHF radio including a radio circuit housing and an end fed antenna as in claim 8 wherein said antenna is pivotally supported at its feed end on said housing, said antenna being angularly displaceable between a housed position and a working position.

* * * * *